US012065925B2

(12) United States Patent
Demidov et al.

(10) Patent No.: US 12,065,925 B2
(45) Date of Patent: Aug. 20, 2024

(54) METHODS FOR DETERMINING A POSITION OF A DROPPABLE OBJECT IN A WELLBORE

(71) Applicant: Schlumberger Technology Corporation, Sugar Land, TX (US)

(72) Inventors: Demid Valeryevich Demidov, Novosibirsk (RU); Artem Valeryevich Kabannik, Novosibirsk (RU); Roman Vladimirovich Korkin, Novosibirsk (RU)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/002,130

(22) Filed: Aug. 25, 2020

(65) Prior Publication Data

US 2021/0062640 A1 Mar. 4, 2021

(30) Foreign Application Priority Data

Aug. 28, 2019 (WO) ..... PCT/RU2019/000600

(51) Int. Cl.

| | |
|---|---|
| ***E21B 47/095*** | (2012.01) |
| ***E21B 33/16*** | (2006.01) |
| *E21B 23/04* | (2006.01) |

(52) U.S. Cl.

CPC ..... *E21B 47/095* (2020.05); *E21B 33/165* (2020.05); *E21B 23/04* (2013.01)

(58) Field of Classification Search

CPC ..... E21B 47/095; E21B 33/165; E21B 23/04
See application file for complete search history.

(56) References Cited

U.S. PATENT DOCUMENTS

| | | | |
|---|---|---|---|
| 4,819,726 | A | 4/1989 | Beirute et al. |
| 5,427,418 | A | 6/1995 | Watts |
| 5,754,495 | A | 5/1998 | Skinner |

(Continued)

FOREIGN PATENT DOCUMENTS

| | | | |
|---|---|---|---|
| EP | 3480628 | A1 | 5/2019 |
| WO | 2019240613 | A1 | 12/2019 |
| WO | 2020122747 | A1 | 6/2020 |

OTHER PUBLICATIONS

Leugemors et al., "Cementing Equipment and Casing Hardware," in Nelson EB and Guillot D (eds.): Well Cementing—2nd Edition, Houston, Schlumberger (2006) 343-458.

(Continued)

*Primary Examiner* — Taras P Bemko
(74) *Attorney, Agent, or Firm* — Cameron R. Sneddon

(57) ABSTRACT

The position of a droppable object (e.g., a cementing plug or drillpipe dart) in a cased wellbore may be determined in real time during a cementing operation. A pressure data acquisition system is installed at a wellsite and a pressure transducer is installed at the wellhead. As the droppable object travels through casing it encounters regions with a positive or a negative change of inner cross-sectional dimension. The droppable object generates a pressure pulse as it passes through the regions. The pressure pulse and associated reflections are detected by the pressure transducer, and the signals are processed mathematically to determine the current position of the droppable object.

17 Claims, 12 Drawing Sheets

(56) References Cited

U.S. PATENT DOCUMENTS

| | | | | |
|---|---|---|---|---|
| 6,125,935 | A | 10/2000 | Shahin, Jr. | |
| 6,401,814 | B1 | 6/2002 | Owens et al. | |
| 9,453,404 | B2 | 9/2016 | Shampine et al. | |
| 9,546,548 | B2 | 1/2017 | Hartog et al. | |
| 9,784,095 | B2 * | 10/2017 | Echols, III | E21B 23/02 |
| 2002/0157828 | A1 | 10/2002 | King et al. | |
| 2008/0272931 | A1 | 11/2008 | Auzerais et al. | |
| 2014/0251603 | A1 * | 9/2014 | Raducanu | E21B 47/12 166/67 |
| 2017/0096891 | A1 * | 4/2017 | Gao | E21B 47/24 |
| 2017/0138178 | A1 * | 5/2017 | Shampine | E21B 47/095 |
| 2017/0211569 | A1 * | 7/2017 | Urdaneta | F04B 49/065 |
| 2020/0308958 | A1 * | 10/2020 | Kabannik | G01V 1/44 |

OTHER PUBLICATIONS

Piot et al., "Primary Cementing Techniques," in Nelson EB and Guillot D (eds.): Well Cementing—2nd Edition, Houston, Schlumberger (2006) 459-501.

Trogus et al., "Studies of Cement Wiper Plugs Suggest New Deepwater Standards," paper SPE/IADC-173066-MS, presented at the SPE/IADC Drilling Conference and Exhibition, London, UK, Mar. 17-19, 2015. 9 pages.

Office Action issued in Eurasian Patent Application 202290689 on Sep. 19, 2022, 5 pages.

* cited by examiner

METHODS FOR DETERMINING A POSITION OF A DROPPABLE OBJECT IN A WELLBORE

CROSS-REFERENCE TO RELATED APPLICATIONS

This application claims priority to and the benefit of International Patent Application No. PCT/RU2019/0006000, entitled "Methods for Determining a Position of a Droppable Object in a Wellbore", filed Aug. 28, 2020, the entire disclosure of which is hereby incorporated herein by reference.

TECHNICAL FIELD

The present disclosure relates generally to cementing operations. In particular, the disclosure relates to using pressure pulses to determine the positions of wiper plugs and drillpipe darts inside a casing string.

BACKGROUND

During the construction of underground wells, it is common, during and after drilling, to place a tubular body such as a liner or casing, secured by cement pumped into the annulus around the outside of the tubular body. The cement serves to support the tubular body and to provide isolation of the various fluid-producing zones through which the well passes. This latter function prevents cross-contamination of fluids from different layers. For example, the cement prevents formation fluids from entering the water table and polluting drinking water, or prevents water from passing into the well instead of oil or gas. Furthermore, the cement sheath helps prevent corrosion of the tubular body.

The cement placement process is known in the industry as primary cementing. Most primary cementing operations employ the two-plug cement-placement method. FIG. 1 shows a typical wellsite configuration 100 for a primary cementing operation. A cementing head 101 is situated on the surface, and a casing string 103 is lowered into a borehole 102. As the casing string 103 is lowered into the borehole 102, the casing string interior fills with drilling fluid 108. The casing string is centered in the borehole by centralizers 104 attached to the outside of the casing string. Centralizers are placed in critical casing sections to prevent sticking while the casing is lowered into the well. In addition, they keep the casing string in the center of the borehole to help ensure placement of a uniform cement sheath in the annulus between the casing and the borehole. The bottom end of the casing string is protected by a guide shoe 105 and a float collar 109. Guide shoes are tapered, commonly bullet-nosed devices that guide the casing toward the center of the hole to minimize hitting rough edges or washouts during installation. The guide shoe differs from the float collar in that it lacks a check valve. The check valve in a float collar can prevent reverse flow, or U-tubing, of fluids from the annulus into the casing. Inside the cementing head 101 are a bottom cementing plug 106 and a top cementing plug 107. The cementing plugs, also known as cementing wiper plugs or wiper plugs, are elastomeric devices that provide a physical barrier between different fluids as they are pumped through the casing string interior. Most cementing plugs are made of a cast aluminum body with molded rubber fins than ensure steady movement through a tubing.

The goals of the primary cementing operation are to remove drilling fluid from the casing interior and borehole, place a cement slurry in the annulus, and leave the casing interior filled with a displacement fluid such as brine or water. The bottom cementing plug 106 separates the cement slurry from the drilling fluid, and the top cementing plug 107 separates the cement slurry from the displacement fluid.

Cement slurries and drilling fluids are usually chemically incompatible. Commingling may result in a thickened or gelled mass at the interface that would be difficult to remove from the wellbore, possibly preventing the placement of a uniform cement sheath throughout the annulus. Therefore, in addition to using wiper plugs, engineers employ both chemical means to maintain fluid separation. Chemical washes and spacer fluids may be pumped between the cement slurry and drilling fluid. These fluids have the added benefit of cleaning the casing and formation surfaces, which is helpful for achieving good bonding with the cement.

FIG. 2 shows a chemical wash 201 and a spacer fluid 202 being pumped between the drilling fluid 103 and the bottom cementing plug 106. Cement slurry 203 follows the bottom cementing plug. The bottom cementing plug has a membrane that ruptures when it lands at the bottom of the casing string, allowing cement slurry to pass through the bottom cementing plug and enter the annulus (FIG. 3).

Once a sufficient volume of cement slurry has been pumped to fill the annular region between the casing string and the borehole wall, the top cementing plug 107 is released, followed by the displacement fluid 301. The top cementing plug 107 does not have a membrane; therefore, when it lands, hydraulic communication is severed between the casing interior and the annulus (FIG. 4). After the cementing operation, engineers wait for the cement to set and develop strength—known as "waiting-on-cement" (WOC). After the WOC time, further operations such as drilling deeper or perforating the casing string may commence.

Conventional cementing plugs are pumped directly from the surface because they pass through only one pipe with a continuous inside diameter (ID). Liners, on the other hand, do not begin at the surface; instead, they are run downhole on the drillstring to the setting depth. Liners typically have a much larger ID than the drillstring; as a result, a single cementing plug cannot be pumped from the surface. Therefore, the displacement is performed by two plugs. One plug, known as the drillpipe dart, is located in the surface cementing equipment. The second plug is either attached to the bottom of the liner setting tool assembly, or the top of the liner setting tool assembly. The second plug is called a liner wiper plug.

After the cement has been pumped in the liner and the drillstring, the drillpipe dart (a droppable object) is released from the surface cementing equipment. When the drillpipe dart reaches the top of the liner, it latches into the liner wiper plug. Both the drillpipe dart and the liner wiper plug then become a single divider between the cement slurry and the displacement fluid. This arrangement may be seen in extended-reach wells and multistage cementing applications.

Additional information concerning cementing plugs, drillpipe darts and primary cementing operations may be found in the following publications. Leugemors E et al.: "Cementing Equipment and Casing Hardware," in Nelson E B and Guillot D (eds.): *Well Cementing-2nd Edition*, Houston, Schlumberger (2006) 343-458. Piot B and Cuvillier G: "Primary Cementing Techniques," in Nelson E B and Guillot D (eds.): *Well Cementing-2nd Edition*, Houston, Schlumberger (2006) 459-501. Trogus M: "Studies of Cement Wiper Plugs Suggest New Deepwater Standards," paper SPE/IADC-173066-MS, presented at the SPE/IADC Drilling Conference and Exhibition, London, UK, 17-19 March 2015.

Deviations from the idealized cementing operation depicted above may occur. Possible reasons include borehole rugosity leading to inaccurate displacement volume calculations, pump rate fluctuations, differences between nominal and actual casing geometry, lost circulation, casing deformation and fluid loss. With these uncertainties, operators and engineers are motivated to achieve real-time monitoring of cementing plug positions, as well as locate the top of the cement (TOC) sheath in the annulus.

BRIEF DESCRIPTION OF THE DRAWINGS

FIG. 8(*i*)(*a*) is a plot of wellhead pressure and flowrate versus time; FIG. 8(*i*)(*b*) shows the wellhead pressure spectrogram; FIG. 8(*ii*)(*c*) shows the normalized energy spectral density; FIG. 8(*ii*)(*d*) is a plot of displaced volume and estimated cementing plug depth versus time; FIG. 8(*ii*)(*e*) is a plot of measured pressure pulses arising from the cementing plug passing through casing collars.

SUMMARY

Figure 1:
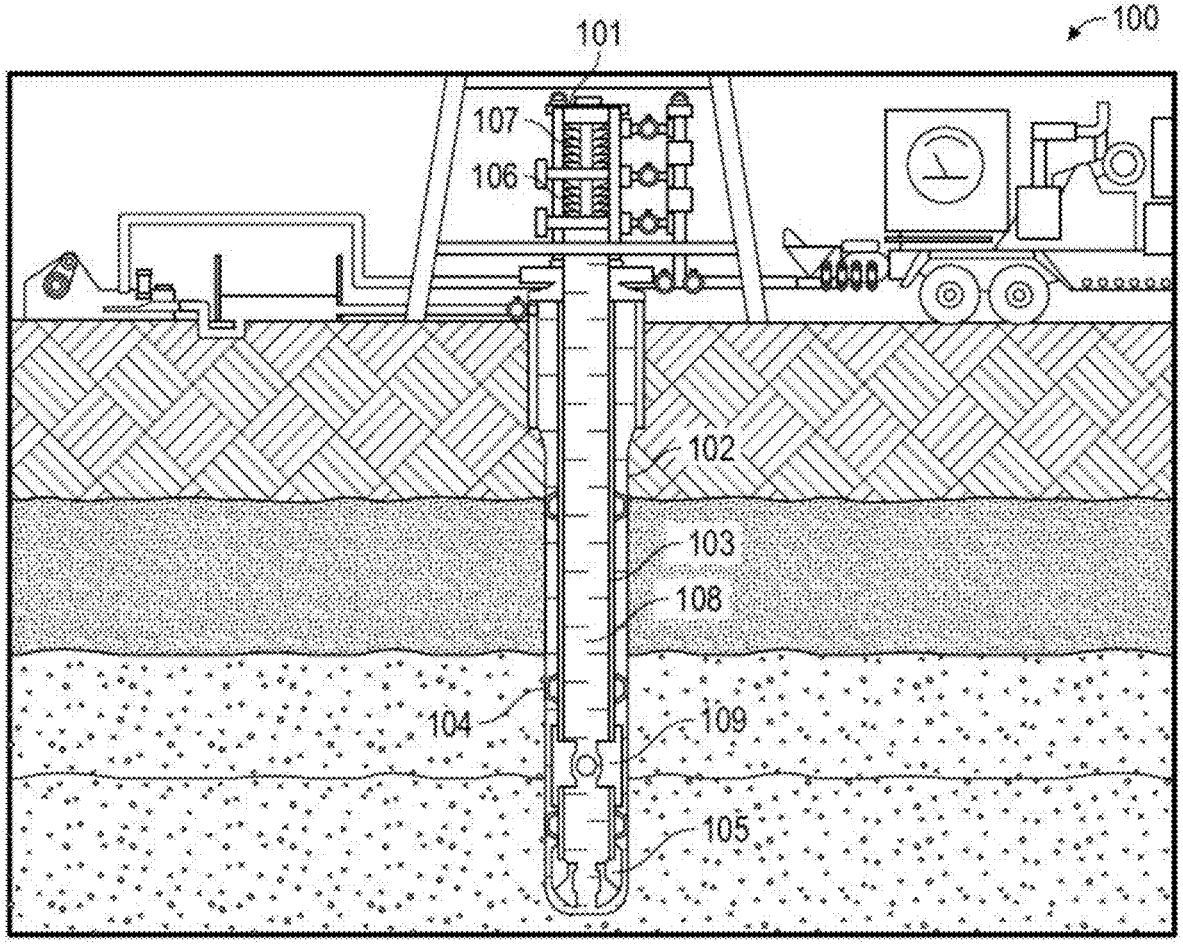
Figure 1 PRIOR ART
FIG. 1 shows a typical wellsite configuration during a cementing operation.
Figure 2:
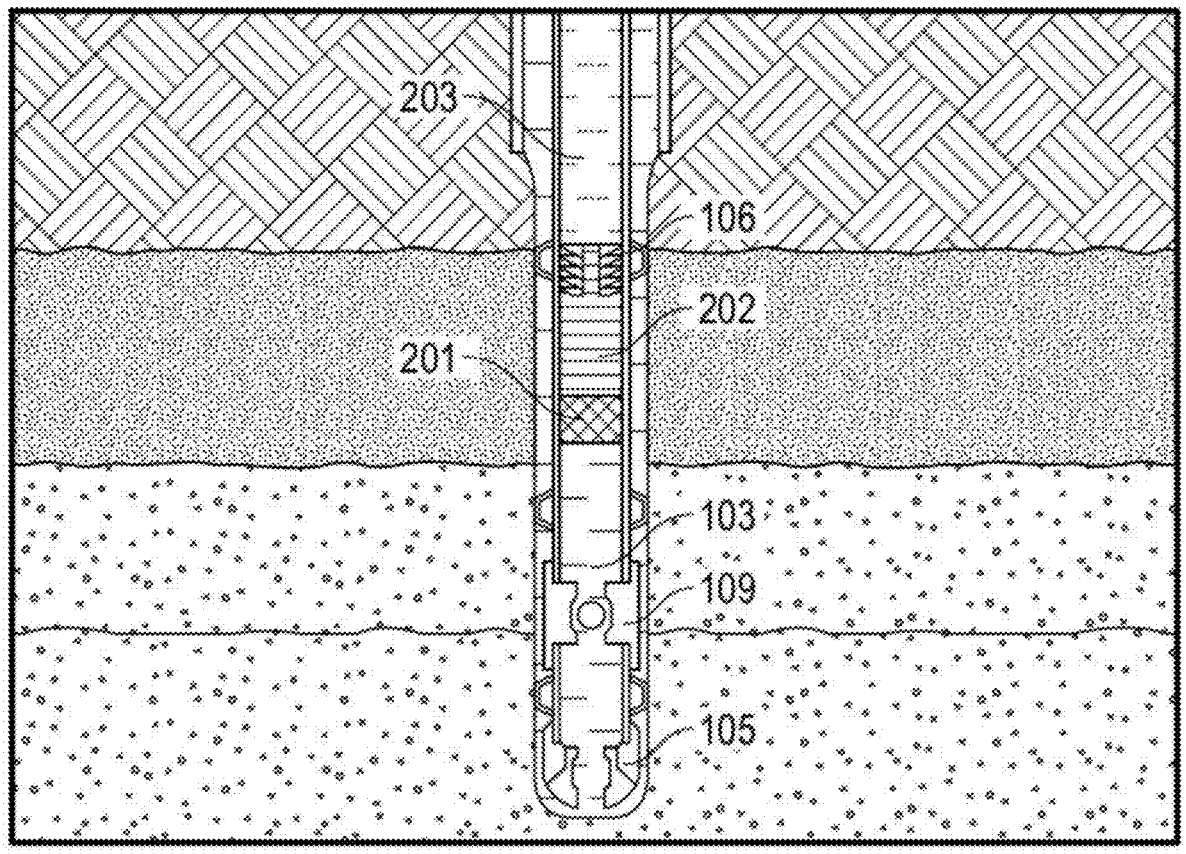
Figure 2 PRIOR ART
FIG. 2 shows a cementing operation in progress. The bottom cementing plug has been released, separating the cement slurry from chemical washes, spacer fluids and drilling fluid.
Figure 3:
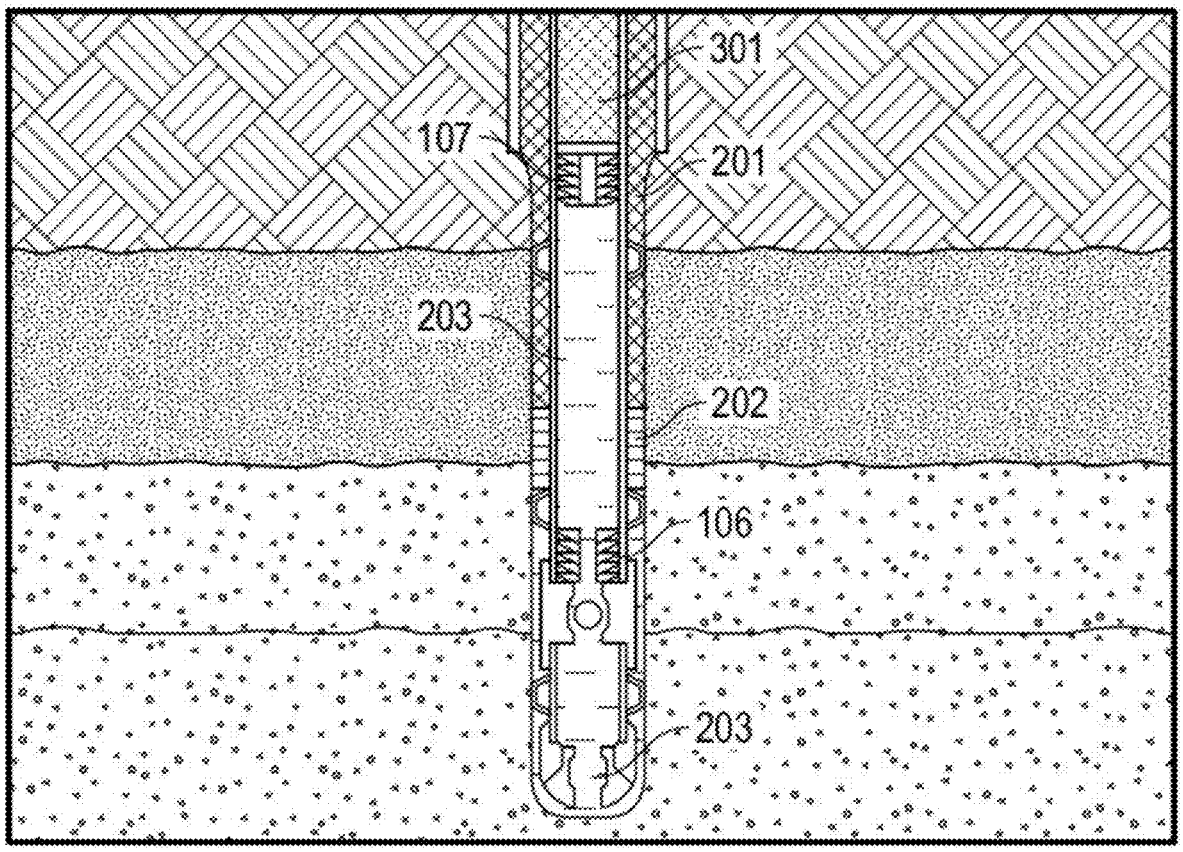
Figure 3 PRIOR ART
FIG. 3 shows a cementing operation in progress. The bottom cementing plug has landed on the float collar. A membrane in the bottom cementing plug ruptures, allowing cement slurry to enter the annulus between the casing string and the borehole wall.
Figure 4:
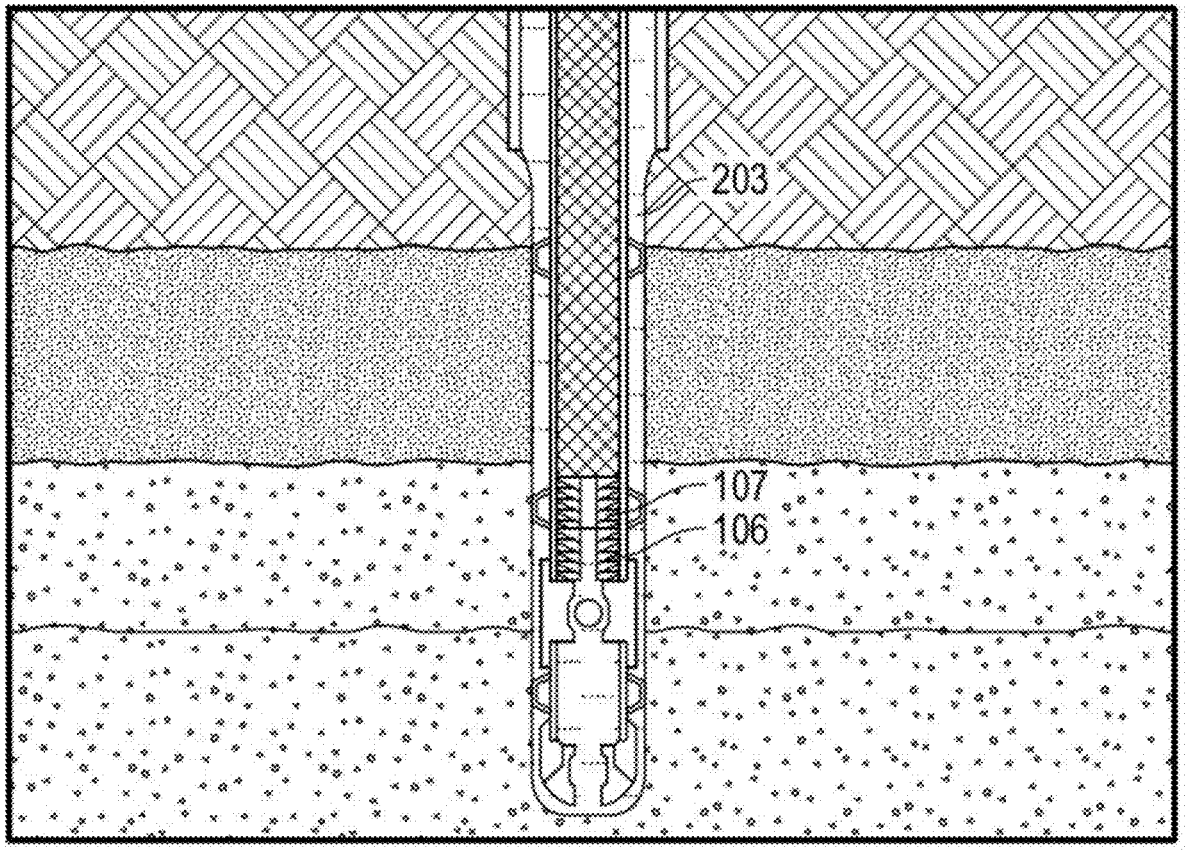
Figure 4 PRIOR ART
FIG. 4 shows a completed cementing operation. Cement slurry fills the annulus, both cementing plugs have landed on the float collar, and the interior of the casing string is filled with displacement fluid.

In an aspect, embodiments relate to methods for determining a position of a droppable object inside a casing string. A casing string is installed in a wellbore, during which a fluid medium in the borehole enters and fills the interior of the casing string. The casing string comprises at least one region with a negative or a positive change of inner cross-sectional dimension. A pressure data acquisition system is installed at the wellsite, and a pressure transducer is installed at the wellhead.

A droppable object is then placed inside the casing string. The droppable object may be a top cementing plug, a bottom cementing plug or a drill pipe dart. A fluid is then pumped behind the droppable object, causing the droppable object to travel through the interior of the casing string and pass through the at least one region with a negative or positive change of inner cross-sectional dimension, thereby generating a pressure pulse.

The pressure data are recorded by the pressure transducer and transmitted to the pressure data acquisition system. The pressure data are then processed mathematically by obtaining the pressure pulses, pulse reflections or both, and the position of the droppable object is determined.

In a further aspect, embodiments relate to methods for cementing a borehole penetrating a subterranean formation. A casing string is installed into the liquid-filled borehole, during which drilling fluid in the borehole enters and fills an interior of the casing string, wherein the casing string comprises at least one region with a negative or a positive change of inner cross-sectional dimension. A pressure data acquisition system is installed at the wellsite, and a pressure transducer is installed at the wellhead.

The pressure transducer is used to detect the pressure pulse and pulse reflections, and transmit pressure data to the pressure data acquisition system. The pressure data are then processed mathematically and the position of the bottom cementing plug is determined.

A top cementing plug is placed inside the casing string. A displacement fluid is pumped behind the top cementing plug, causing the top cementing plug to travel through the interior of the casing string and pass through the at least one region with a negative or a positive change or inner cross-sectional dimension, thereby generating a pressure pulse.

The at least one pressure transducer is used to detect the pressure pulses, pulse reflections or both, and transmit the pressure data to the pressure data acquisition system. The pressure data are then processed mathematically and the position of the top cementing plug is determined.

DETAILED DESCRIPTION

At the outset, it should be noted that in the development of any such actual embodiment, numerous implementations—specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure. In addition, the composition used/disclosed herein can also comprise some components other than those cited. In the summary of the disclosure and this detailed description, each numerical value should be read once as modified by the term "about" (unless already expressly so modified), and then read again as not so modified unless otherwise indicated in context. Also, in the summary of the disclosure and this detailed description, it should be understood that a concentration range listed or described as being useful, suitable, or the like, is intended that any and every concentration within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific points, it is to be understood that inventors appreciate and understand that any and all data points within the range are to be considered to have been specified, and that inventors possessed knowledge of the entire range and all points within the range.

This disclosure pertains to detecting the position of droppable objects in a casing string or liner during a well cementing operation. The droppable objects may comprise top or bottom cementing plugs and drill pipe darts. The method is based on generating pressure pulses in a well, recording high frequency pressure data, mathematical processing of the recorded data with extraction of pressure pulses and pressure pulses reflections from downhole objects, measuring the pulse reflection times and computing the distance from a known position of the pressure transducer to the droppable object. The methods and measurements disclosed herein may be performed in real time during a cementing operation. The ability to locate droppable objects in real time allows operators to make instant decisions concerning the progress of the treatment, for example, whether to continue or discontinue displacement, volumes of fluids to be introduced into the wellbore and pumping rates.

A method and system for locating steady downhole objects that reflect a hydraulic signal are disclosed in the patent application WO 2018/004369. The monitoring of the well is based on cepstral analysis of pressure data recorded at the wellhead. It is designed to locate steady downhole objects that reflect a hydraulic signal. A hydraulic signal is detected by a pressure sensor, then the pressure data are processed to obtain their properties such as tube wave reflection times. One (but not the only) method of obtaining such information is a cepstrum analysis. The cepstrum analysis is widely used in various applications, for example for hydraulic fracturing operations monitoring. The cepstrogram allows detection of objects that reflect the hydraulic signal. This method for hydraulic fracturing operations uses hydraulic signal sources including the water hammer effect, noise from surface or submersible pumps and perforating events.

U.S. Pat. No. 6,401,814 B1 discloses a method for locating a cementing plug in a subterranean well during cementing operations using pressure pulse reflections. Once generated, pressure pulses are transmitted through displacement fluid, reflected off the cementing plug and, finally, received by a pressure sensor. A location of the plug is calculated from reflection time and pressure pulse velocity in the given media. The method of generating and transmitting of pressure pulse through the fluid in a casing string comprises momentarily opening a valve installed in the flowline of the well. Other methods of pressure pulse generation include an air gun, varying the pump's engine speed or disengaging the pump.

U.S. Pat. No. 5,754,495 discloses a method for acoustic determination of the length of a fluid conduit. It comprises constructing a pressure containment system, connecting pressure sensors, filling the system with a fluid, generating a pressure pulse, measuring a pressure pulse traveling to the distal end of the fluid conduit, and calculating the length of the fluid conduct. In the embodiment, a tube wave is generated by a sudden release of pressure in the well through a valve.

U.S. Pat. No. 4,819,726 discloses a method for indicating the position of a cement wiper plug prior to its bottomhole arrival. It comprises an apparatus that includes a section of pipe string with an interior shearable, temporary means of restricting the motion of the cement wiper plug through the section of pipe string. The arrival of the cementing plug at the shearable, temporary restriction means in a pipe string is sensed by an increase in pipe string pressure at the surface and monitored by a pressure sensor.

U.S. Pat. No. 9,546,548 discloses a device and a method of use for cement sheath analysis based on acoustic wave propagation. It consists of an acoustic wave detection apparatus, comprising a fiber optic cable drawn down in a well, an optical source and a data acquisition system. The acoustic source produces a compressional wave in a casing string. The pressure in the annulus is determined as the cement slurry sets, and this pressure is compared to the maximum formation pressure as an indication of whether the cement had set to a strength, enough to maintain an effective formation-to-casing seal across the annulus.

In the methods disclosed in this application, pressure pulses are generated when a cementing plug passes through casing collar joints where a variation of inner diameter of the casing takes place. Computation of the distance is based on determining the velocity of tube waves generated by the pressure pulses, and the travel time of the tube wave between the pressure transducer and the droppable object. Reflection times are obtained through the cepstrum analysis of recorded high frequency pressure data. As described in patent application WO 2018/004369 referenced above, a cepstrum is the result of taking the inverse Fourier transform (IFT) of the logarithm of the estimated spectrum of a signal. Tube wave velocity may be obtained using computed pressure pulse reflection time from the objects in wellbore with a known position, for example a landing collar, or calculated theoretically based on parameters including properties of the liquid medium and the casing geometry. Another embodiment utilizes the identification of wiper plug position based on pressure pulse generation and the information about the casing joint sequence—called a casing tally. It comprises pressure pulse generation by the wiper plug passing through the collar, its detection and matching with its depth taken from the casing tally table.

Figure 5:
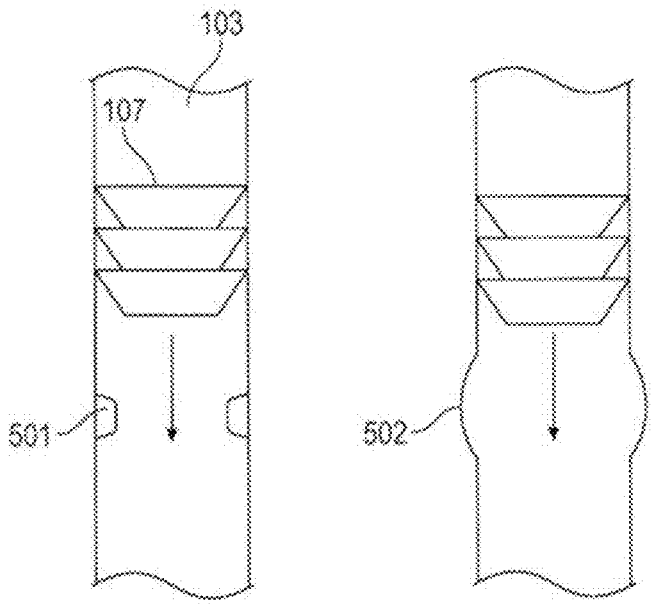
FIG. 5 is an illustration of a cementing plug passing through a region of casing pipe with a negative and a positive change of inner cross-sectional dimension.
Figure 6:
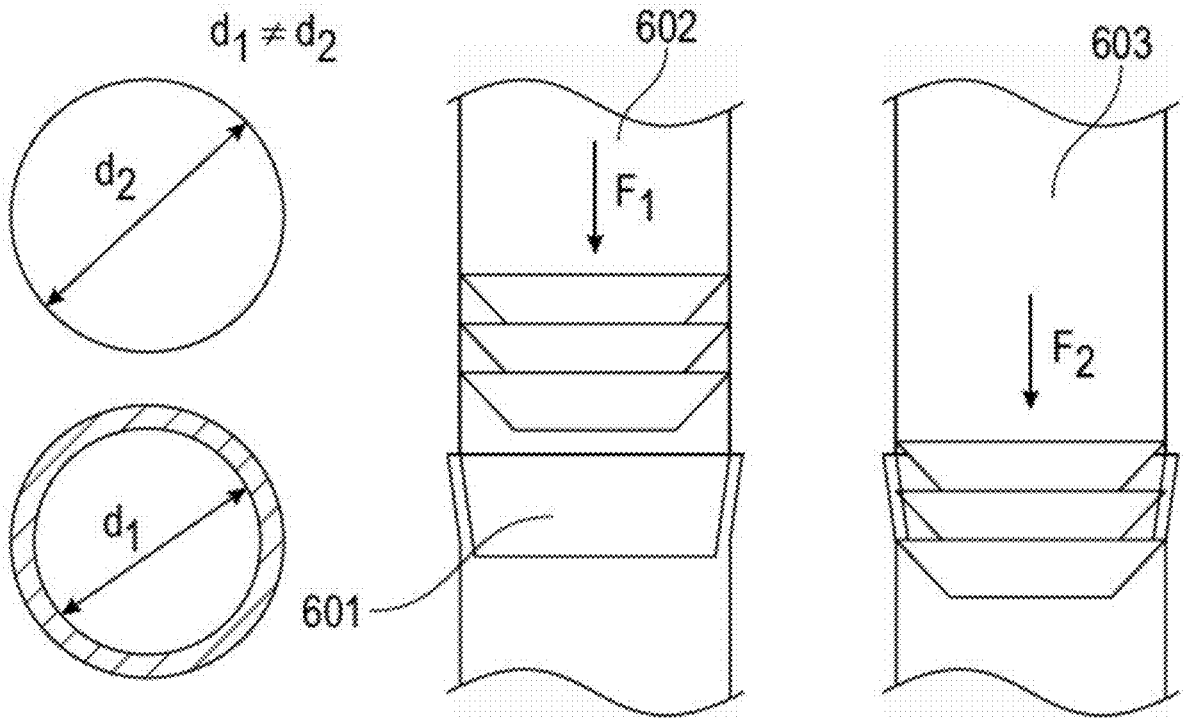
FIG. 6 is an illustration of a cementing plug passing through a casing joint with an inner cross-sectional dimension $d_1$, which is different from the rest of the casing dz.

One embodiment of the disclosure is a system that comprises at least two casing pipes joined together to form a casing string and placed in the borehole (FIG. 5). A cementing plug 107 is dropped into a casing string 103 filled with a fluid. At least one pipe in the casing string may have a region with at least one change of inner cross-section dimension. The change of inner cross-section dimension can be negative 501 or positive 502 with respect to the inner cross-sectional dimension of the rest of the pipe. The change of inner cross-sectional dimension may occur at casing pipe joints, which may be screw joints 601, weld joints or both (FIG. 6). A pressure pulse is generated when the cementing plug passes through the region with the change of inner cross-sectional dimension (501, 502, or 601) due to the difference in forces (602, 603) required to push the cementing plug through the region $d_1$ and the rest of the pipe $d_2$. The change of inner cross-sectional dimension may further be a restriction, a groove, a lug, or an orifice or a combination thereof. Furthermore, the distances between regions with at least one change of inner cross-sectional dimension may be equidistant or nonequidistant, or both.

Figure 7:
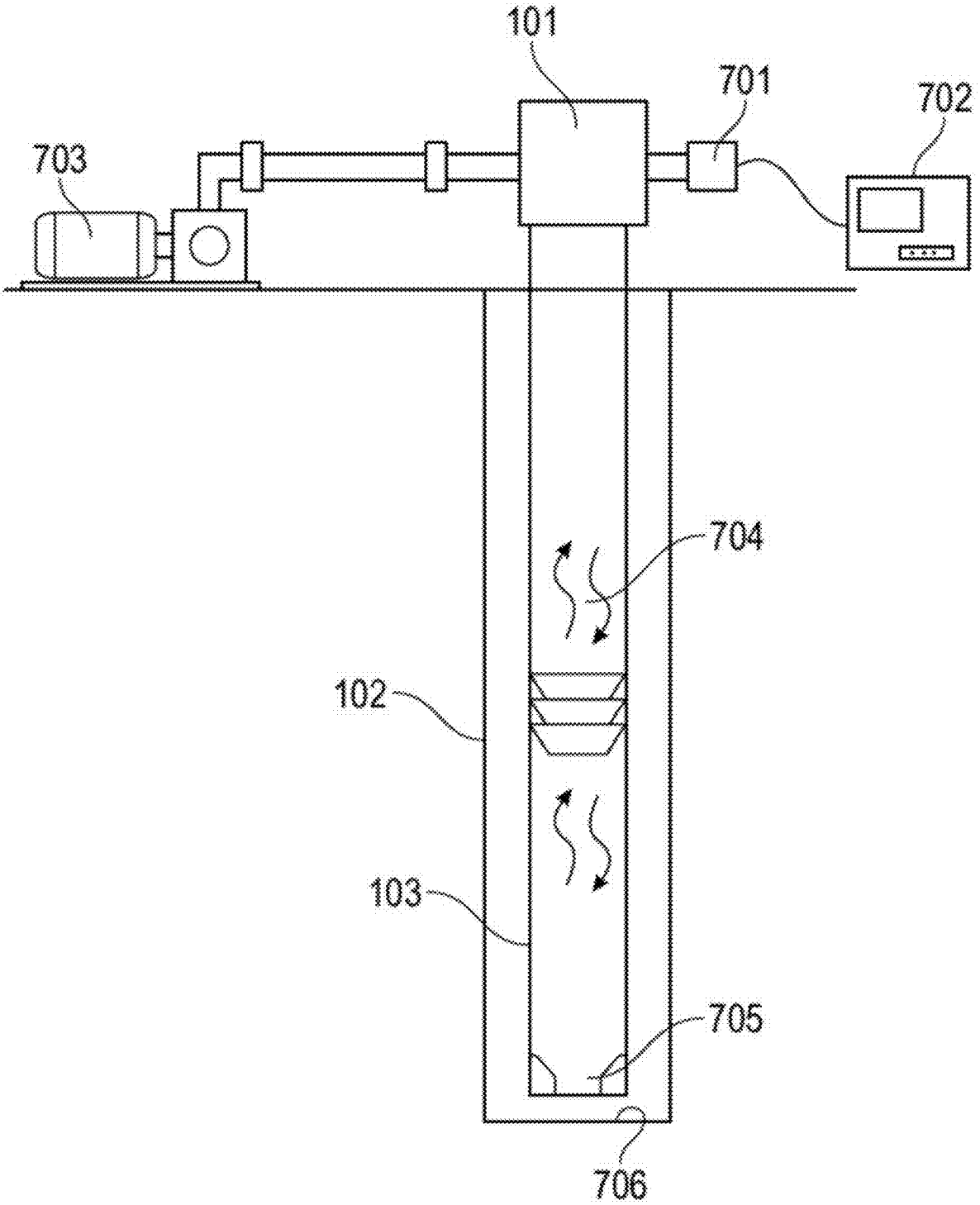
FIG. 7 is an illustration of a well configuration for practicing the disclosed methods.

The disclosed method employs an assembly (FIG. 7) that comprises a borehole 102, fluid-filled casing string run into borehole 103, a pressure transducer 701 installed at the casing string at the surface (wellhead or cementing head), an acquisition system 702 for pressure data recording, and at least one pump 703 connected to the casing string via the cementing head 101. The pressure transducer may be installed at a fluid pumping line, for example at the cementing head. Or, the pressure transducer may be installed at the annular side of the casing (e.g., at a blowout preventer). The pressure pulses may be recorded within a frequency range between 20 and 2000 Hz. Once generated, a pressure pulse 704 may propagate in the fluid-filled borehole and reflect from various objects. The pulse reflection objects are any physical or geometrical changes in the borehole and casing string, that may include, but not limited to a droppable objects such as a cementing plug 107, top of cement and fluid interfaces, or stationary objects such as a landing collar 705, a liner, a check valve, a bottomhole 706, fractures and vugs. Pulse propagation and reflection may occur several times until they completely attenuate. Pulse reflections from various objects are detected by the pressure transducer installed at the surface and data are captured by the acquisition system. Recorded pressure data are then processed with a mathematical algorithm and reflection times from various objects are obtained. The mathematical algorithm may be cepstral analysis, comprising production of a pressure cepstrogram in coordinates of quefrency and time, and calculation of pressure pulse reflection time from the droppable object. The location of the object relatively to known position of pressure transducer is then calculated by multiplication of the reflection half-time by the velocity of pulse propagation in the media filling the volume between the pressure transducer and the object. The reflection time from the droppable object may be converted to the position of the droppable object by multiplication by tube wave velocity.

Persons skilled in the art will recognize that the disclosed methods may further comprise placing a bottom cementing plug inside the casing string. Cement slurry may be pumped behind the bottom cementing plug. The bottom cementing plug may travel through the interior of the casing string and pass through at least one region with a negative or a positive change of inner cross-sectional dimension, thereby generating a pressure pulse. The at least one pressure transducer may be used to detect the pressure pulse and transmit pressure data to the pressure data acquisition system. The pressure data may be processed mathematically and the position of the bottom cementing plug may be determined. Monitoring of the bottom cementing plug may proceed at least until the top cementing plug is launched.

In one another embodiment the velocity of pressure pulse propagation in the media is taken from measurements while cementing a previous section or a neighboring well with similar characteristics.

Locating the object may be performed in real time during the cementing operation. It is implemented via recording and mathematical processing of the pressure signal followed by object positioning directly during the cementing operation. A computer with specific software may perform immediate data processing and building a tracking diagram of the object.

Another embodiment uses information about the casing joint sequence called the casing tally. The casing tally is a table that stores the lengths and positions of all casing collars. The pulse generated by the cementing plug passing a collar can be matched with its depth taken from the casing tally table as illustrated in FIGS. 8(*i*), 8(*ii*) and 9.

Figure 8I:
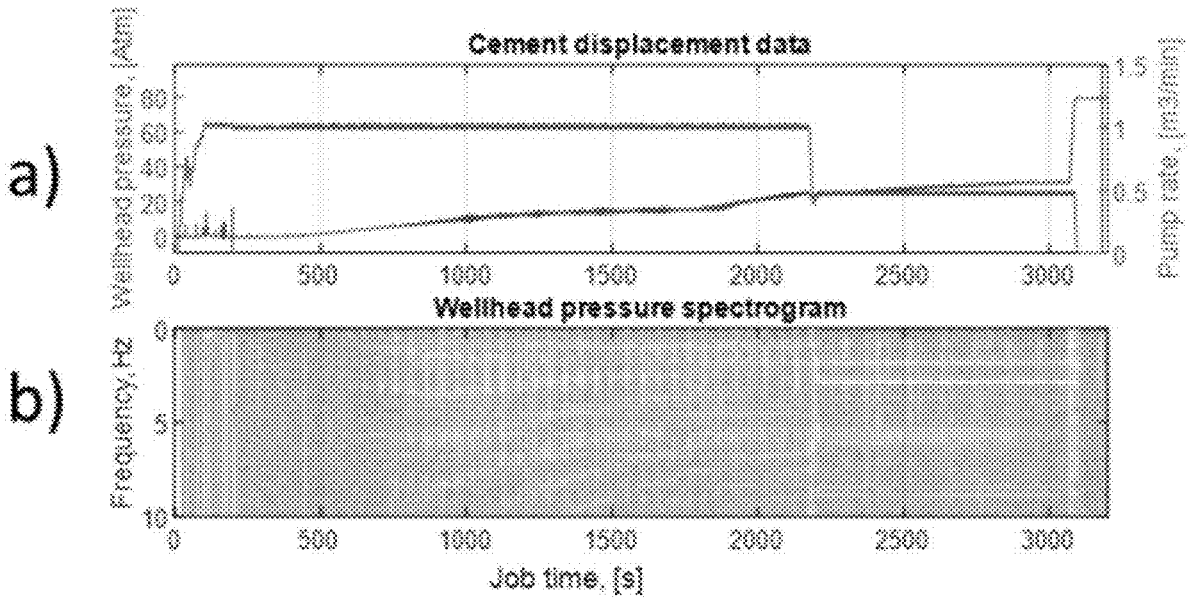
FIGS. 8(*i*) and 8(*ii*) show the computation workflow for determining pressure pulses arising from cementing plugs passing through casing collars.
Figure 8:
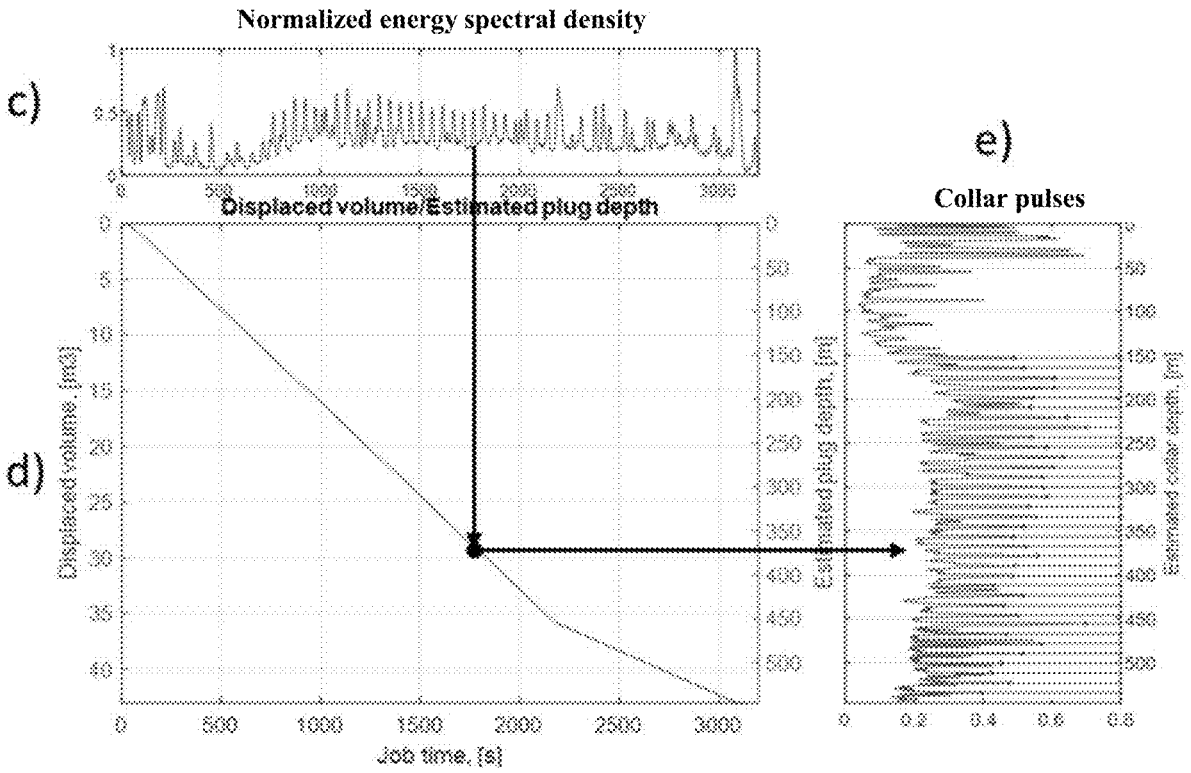

The high frequency pressure and pump rate are shown in FIG. 8(*i*)(*a*). The spectrogram of the pressure signal is a visual representation of the spectrum of frequencies of the signal as it varies with time, shown in FIG. 8(*ii*)(*b*). Although the pressure pulses are not recognizable on the pressure curve they are clearly seen on the spectrogram as broadband events. Furthermore, these pulses manifest themselves as peaks on the normalized energy spectral density plot shown in FIG. 8(*ii*)(*c*).

Energy spectral density describes how the energy of a signal is distributed with frequency. The term "energy" is used in the generalized sense of signal processing; that is, the energy E of a signal x(t) is:

$$E=\int_{-\infty}^{\infty}|x(t)^2|dt \tag{1}$$

The energy spectral density is most suitable for transients—(e.g.) pulse-like pressure signals—having a finite total energy. In this case, Parseval's theorem provides an alternate expression for the energy of the signal:

$$\int_{-\infty}^{\infty}|x(t)^2|dt=\int_{-\infty}^{\infty}|\hat{x}(f)|^2df \tag{2}$$

where $$x(f)=\int_{-\infty}^{\infty}e^{-2\pi ift}x(t)dt \tag{3}$$

is the Fourier transform of the signal and f is the frequency in Hz. Often used is the angular frequency $\omega=2\pi f$. Since the integral on the right-hand side is the energy of the signal, the integrand $|\hat{x}(f)|^2$ can be interpreted as a density function describing the energy per unit frequency f. In light of this, the energy spectral density of a signal x(t) is defined as $$S_{xx}(f)=|\hat{x}(f)|^2. \tag{4}$$

The normalized energy spectral density is computed by integrating the spectrogram along the frequency axis followed by normalization by the strongest peak. The normalized energy spectral density is therefore a dimensionless quantity. From FIG. 8(*ii*)(*c*) it is also shown that the time interval between these peaks depends on the pump rate. The time interval is shorter at the pump rate of 1 $m^3$/min and longer at the pump rate of [0.5 $m^3$/min (3.1 bbl/min)]. A convenient way to correct for a non-constant pump rate is to convert the time scale to the estimated depth scale as shown in FIG. 8(*ii*)(*d*). By integrating the pump rate over time, the displaced volume curve may be computed. The displaced volume scale in reverse order is shown on the left y-axis of FIG. 8(*ii*)(*d*). Taking into account the inner casing diameter, the estimated depth scale may be computed as shown by the right y-axis of FIG. 8(*ii*)(*d*). The horizontal time scale from FIG. 8(*ii*)(*c*) is mapped with the displaced volume curve to determine the estimated cementing plug depth. The normalized energy spectral density information may be plotted against estimated depth scale to produce a collar pulses plot, shown in FIG. 8(*ii*)(*e*).

Figure 9:
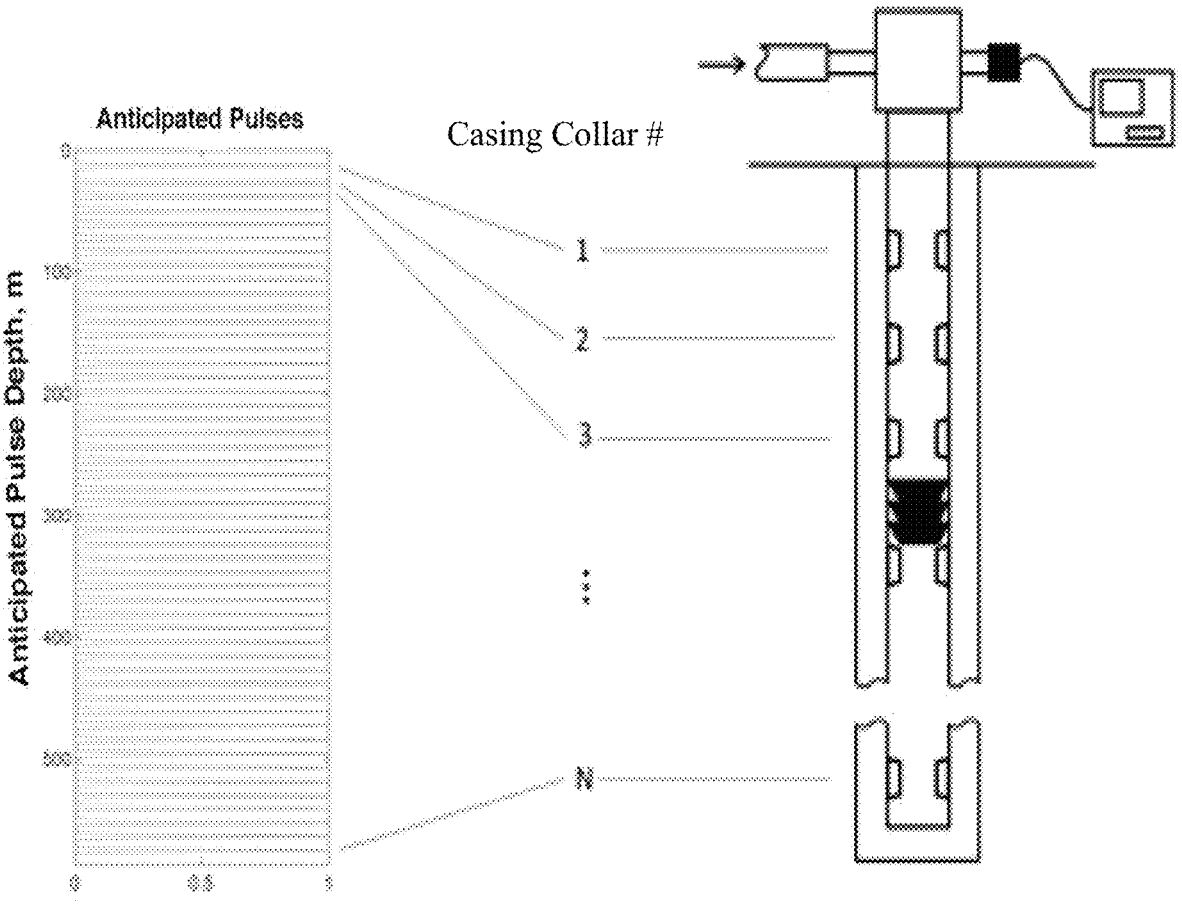
FIG. 9 shows the depths associated with each pressure pulse, according to the casing tally.

As shown in FIG. 9, the collar pulses plot from FIG. 8(*ii*)(*e*) may then be compared with a known casing tally to determine the depth of the cementing plug. Persons skilled in the art will recognize that the position of the bottom plug may be monitored during the period before the top plug is launched.

Figure 10:
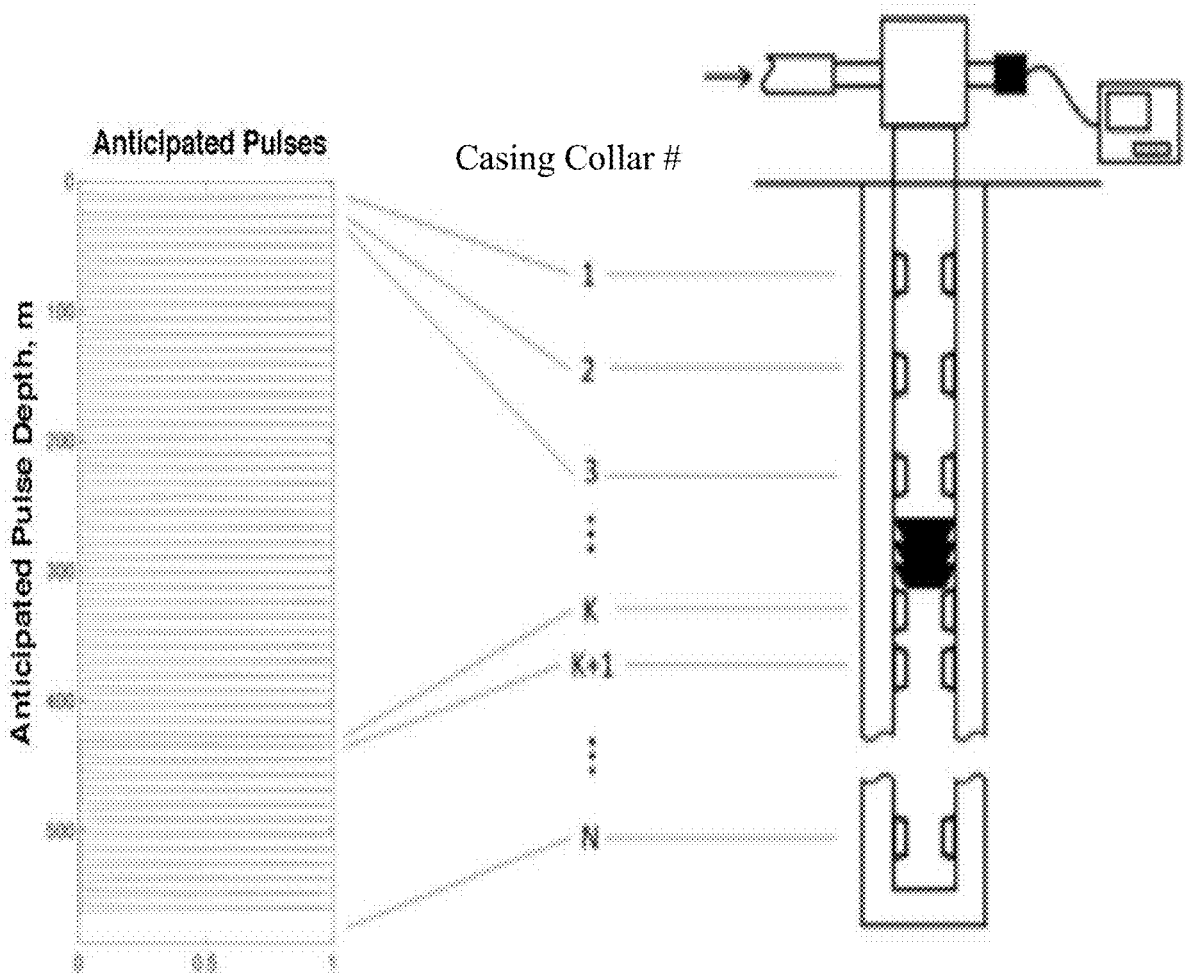
FIG. 10 shows pressure pulses according to a casing tally when casing joints of non-uniform spacing are present.

The workflow described above functions optimally when all of the pulses are clearly seen on the normalized energy spectral density plot. In some cases, the amplitude of one or more pulses may be too low due to tube wave attenuation in the wellbore, or buried with the noise or both. Also, due to the U-tubing effect, the pressure pulses may not be immediately visible after a plug is released from the cementing head, but after the cementing plug has traveled to some depth from the surface. In this case, if all joints have the same length matching anticipated pulses with the measured ones may be ambiguous. This circumstance may be avoided by installing casing segments at various locations that are shorter or longer than the normal sequence. In other words, the distances between regions with at least one change of inner cross-sectional dimension may be equidistant or non-equidistant. This way, the casing tally should contain one or more shorter or longer joints or their combination so that they can be clearly seen on the measured pulses plot. These pulses would then be used as a benchmark for correlation between anticipated pressure pulses with the casing tally as the collars number K and K+1 shown in FIG. 10.

EXAMPLE

The following example serves to further illustrate the disclosure.

Figure 11:
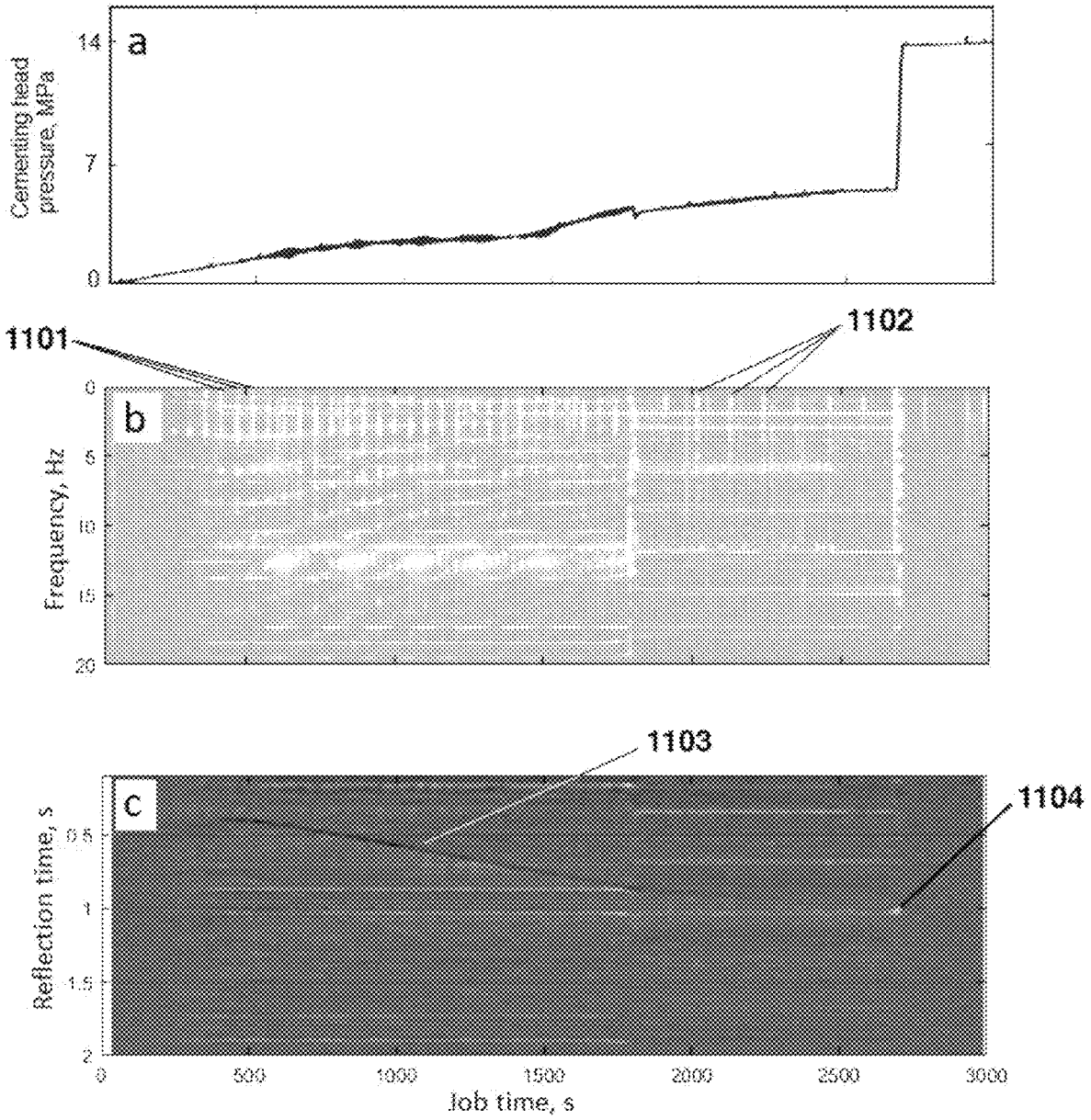
FIG. 11 shows example data from a primary cementing operation: pressure at the wellhead, frequency-time diagram and reflective signal intensity.

In the practical example of current invention, a pressure transducer was installed at a cementing head of the wellbore with 34-cm (13-⅜ inch) casing having a true vertical depth of 600 m (1969 ft) and a landing collar at a depth of 585 m (1919 ft). The well was cemented by pumping cement slurry followed by oil-base displacement fluid. Two cementing plugs, bottom and top, were used to prevent contamination of the cement slurry. The pressure at cementing head was recorded with the rate of 500 pints per second using a Viatran 509 pressure transducer and acquisition device. The recorded data were then processed by cepstrum analysis, and the reflection times of pressure pulses from various objects were obtained. The top cementing plug was tracked by means of the disclosed method. FIG. 11 shows the results of the high frequency pressure data processing by cepstral analysis and includes a pressure profile (a), frequency (b), and reflective signal intensity diagram (c) with pressure pulse reflection time from wiper plug versus cement displacement job time. From diagram (b) one can see periodic (every ~50 s) broadband signals 1101 corresponding to pressure pulses generated by the cementing plug passing through joints of casing pipes with a positive change of inner cross-sectional dimension (local enlargement) after every 10.5 m (34.4 ft) of the tubular element. Taking into account known parameters provided by the cementing job report, such as the pumping rate [1.02 $m^3$ (6.4 bbl/min)], casing inner diameter [31.7 cm (12.475 inch)] and the distance between two joints [10.5 m (34.4 ft)], one may calculate that the cementing plug passes a casing joint every 52 s, which is in agreement with the ~50 s period of pulses 1101 on the frequency diagram (b). Moreover, when the pumping rate was decreased to [0.48 $m^3$ (3 bbl/min)] after 1650 s of the job, the cementing plug velocity decreased and the time to travel between two casing joints was 116 s. At the same time, the period of pulses 1102 observed in the diagram (b) increased to ~110 s. These primary pulses may be correlated with the casing tally for determining plug position during displacement. Further, the pulses generated by the cementing plug passing through casing joints propagate along the wellbore to the cementing head, and some reflect back and forth until they attenuate completely. On the reflective signal intensity diagram (c) the line 1103 that corresponds to the pressure pulse reflection time from the cementing plug can be clearly seen, and the cementing plug movement can be tracked in real time until it reaches the landing collar at job time equal 2450 s 1104.

Figure 12:
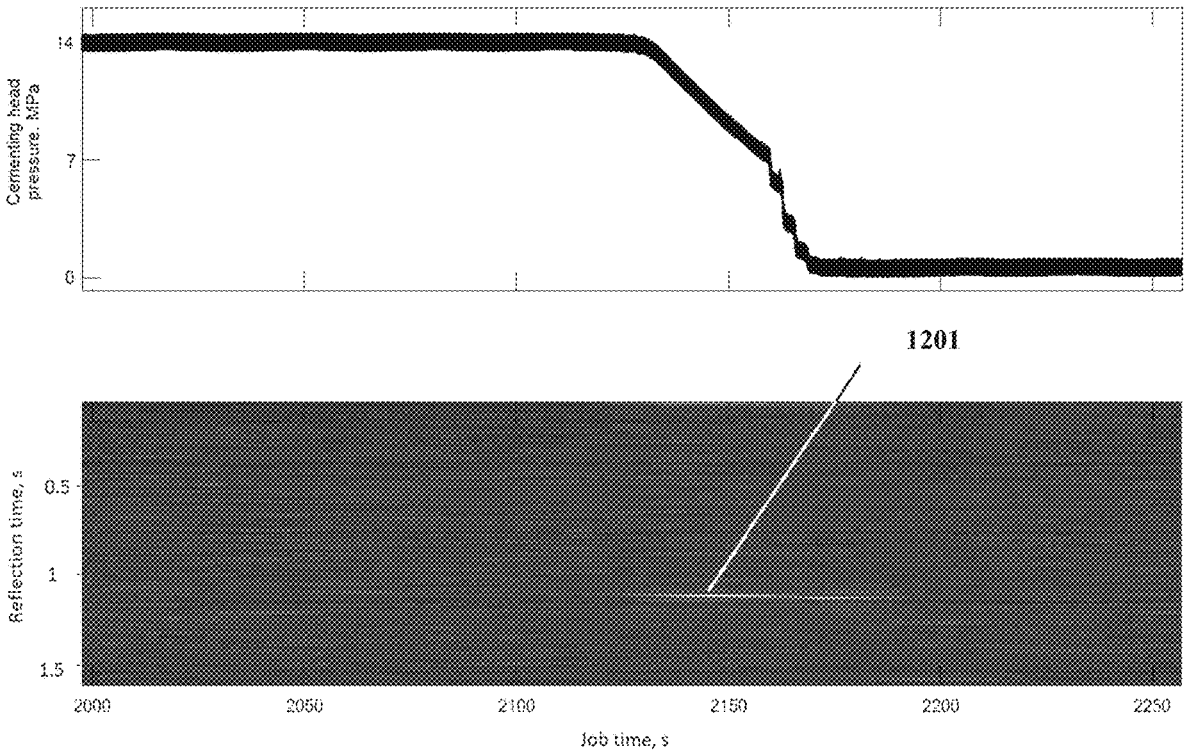
FIG. 12 shows example data from a primary cementing operation: reflective signal intensity diagram and pressure evolution at the wellhead.

To translate the reflection time into the position of the cementing plug in the wellbore, the velocity of pressure pulse propagation in the fluid media between the pressure transducer and top cementing plug was obtained experimentally. The moment of well bleed-off after the cementing plug set on the landing collar was used as it also resulted in the generation of a pressure pulse. A reflective signal intensity diagram was built after cepstral analysis of the pressure data near the moment of pressure release (FIG. 12). As a result, a distinct spot 1201 on the diagram was obtained. It corresponds to the reflection time from the top wiper plug setting on the landing collar—1.01 s. Taking into account the known depth of the landing collar, the velocity of pressure pulse propagation in the displacement fluid (oil-base mud) was calculated as 1158 m/s. Using this result, the reflection time of the pressure pulse from the cementing plug can be translated to wiper plug position at any time when the reflection is distinguishable on the reflective signal intensity diagram.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

The invention claimed is:

1. A method for determining a position of a cementing plug inside a casing string, comprising:

(i) installing the casing string into a liquid filled borehole wherein the casing string comprises pipe joints;

(ii) installing a pressure data acquisition system at a wellsite and a pressure transducer at a wellhead;

(iii) placing the cementing plug inside the casing string;

(iv) pumping a fluid behind the cementing plug causing the cementing plug to travel through the interior of the casing string and pass the pipe joints, thereby generating a pressure pulse due to a difference in the diameter of pipe joints from casing string diameter, wherein the generated pressure pulse generates recordable pressure data;

(v) recording pressure data with the pressure transducer at the wellhead and transmitting the pressure data to the pressure data acquisition system; and (vi) determining the position of the cementing plug and processing the pressure data mathematically using cepstral analysis for recorded pressure pulses, pulse reflections, or both.

2. The method of claim 1, wherein the cepstral analysis for the pressure pulses and pulse reflections comprises producing a pressure cepstrogram in coordinate of quefrency and time, and calculating the pressure pulse reflection time from the cementing plug traveling through the casing string.

3. The method of claim 1, wherein the mathematical processing further comprises determination of a tube wave velocity, based on the pressure pulse reflection time from a stationary object with a known position in the wellbore.

4. The method of claim 1, where the reflection time from the cementing plug is converted to the position of droppable object by multiplication by tube wave velocity.

5. The method of claim 1, wherein the mathematical processing comprises analyzing a pressure spectrogram and determination of pressure pulses in a pressure spectrogram.

6. The method of claim 5, wherein the processing the pressure data mathematical processing comprises a correlation between anticipated pressure pulses based on casing tally information and pressure pulses from the pressure spectrogram.

7. The method of claim 1, wherein the mathematical processing comprises analyzing a normalized energy spectral density of the pressure data.

8. The method of claim 1, wherein the determining the position of the cementing plug is performed in real time during pumping.

9. A method for cementing a borehole penetrating subterranean formation, comprising:

(i) installing a casing string into the borehole wherein the casing string comprises pipe joints;

(ii) installing a pressure data acquisition system at a wellsite and at least one pressure transducer at a wellhead;

(iii) placing a top cementing plug inside the casing string;

(iv) pumping a displacement fluid behind the top cementing plug causing the top cementing plug to travel through the casing string and pass through the pipe joints generating a pressure pulse due to a difference in the diameter of pipe joints from casing string diameter, wherein the generated pressure pulse generates recordable pressure data;

(v) using the pressure transducer to detect the pressure pulse and transmit pressure data to the pressure data acquisition system, the pressure data comprising pressure pulse propagation velocity and reflection time; and (vi) determining the position of the top cementing plug and processing the pressure data mathematically using cepstral analysis.

10. The method of claim 9, further comprising:

(a) placing a bottom cementing plug inside the casing string;

(b) pumping a cement slurry behind the bottom cementing plug, causing the bottom cementing plug to travel through the interior of the casing string and pass through the pipe joints, thereby generating a pressure pulse;

(c) using the pressure transducer to detect the pressure pulse and transmit pressure data to the pressure data acquisition system, the pressure data comprising a pressure pulse propagation velocity and a reflection time; and (d) processing the pressure data mathematically and determining the position of the bottom cementing plug.

11. The method of claim 9, wherein the mathematical processing comprises cepstral analysis, comprising producing a pressure cepstrogram in coordinates of quefrency and time, and calculating the pressure pulse reflection time from a top or bottom cementing plug.

12. The method of claim 11, wherein the normalized energy spectral density is computed by integrating the pressure spectrogram along the frequency axis followed by normalization.

13. The method of claim 11, wherein the mathematical processing comprises a correlation between anticipated pressure pulses based on casing tally information and pressure pulses from the pressure spectrogram or normalized energy spectral density.

14. The method of claim 9, wherein the mathematical processing further comprises determination of tube wave velocity, based on reflection time from a stationary object with a known position in the wellbore.

15. The method of claim 9, wherein reflection time from the top cementing plug is converted to the position of the top cementing plug by multiplication by tube wave velocity.

16. The method of claim 9, wherein the mathematical processing comprises analyzing a pressure spectrogram and determination of pressure pulses.

17. The method of claim 9, wherein the mathematical processing comprises analyzing a normalized energy spectral density of the pressure data.

* * * * *